United States Patent [19]

Hug

[11] 4,020,797

[45] May 3, 1977

[54] PROCESS AND APPARATUS FOR USING WASTE HEAT OF REFUSE BURNING INSTALLATIONS

[75] Inventor: Franz O. Hug, Zumikon, Switzerland

[73] Assignee: Ofag Ofenbau-und Feuerungstechnik AG, Zurich, Switzerland

[22] Filed: May 4, 1976

[21] Appl. No.: 682,987

[30] Foreign Application Priority Data

May 7, 1975 Switzerland ..... 5875/75

[52] U.S. Cl. ..... 122/2; 110/10; 122/249

[51] Int. Cl.[2] ..... F22B 1/00; F22B 21/26

[58] Field of Search ..... 122/2, 7 R, 249, 250, 122/338; 110/10

[56] References Cited

UNITED STATES PATENTS

| | | | |
|---|---|---|---|
| 2,584,686 | 2/1952 | Fabia et al. | 122/7 R |
| 2,790,435 | 4/1957 | Johnson | 122/338 |
| 3,254,634 | 6/1966 | Vorkauf | 122/7 X |
| 3,583,369 | 6/1971 | Trimbach et al. | 122/2 |
| 3,628,508 | 12/1971 | Kummel | 122/7 |

*Primary Examiner*—Kenneth W. Sprague
*Attorney, Agent, or Firm*—Larson, Taylor & Hinds

[57] ABSTRACT

Apparatus for using exhaust heat from burning refuse is described wherein a heat exchanger constructed as a self-supporting unit is mounted, inside an enclosure, directly on the combustion chamber. The heat exchanger consists of at least two co-axial, vertical, cylindrical, single-layer packs of helical tubes with their convolutions in close contact with one another and located so that they lie nearly perpendicular to the direction of flow of the smoke and gases of combustion. One or each of the packs consists of a plurality of tubes with the convolutions of the respective tubes arranged in repeated series along the length of the pack. The packs of helical tubes may be connected in series or in parallel for heating water. Alternatively, they may be divided individually into sections for any one of a number of alternative boiler configurations in which the sections can provide preheaters, evaporators and superheaters. In each arrangement the hot smoke and gases passes upwards inside the innermost pack heating it by radiant heat, is deflected through 180° to pass downwards between that pack and the next one to be deflected again at the bottom through 180° to pass upwards past the said next one and any outer pack to surrender further heat by radiation before being discharged from the enclosure.

10 Claims, 6 Drawing Figures

PROCESS AND APPARATUS FOR USING WASTE HEAT OF REFUSE BURNING INSTALLATIONS

FIELD OF THE INVENTION

The present invention relates to an apparatus and a process for using the waste heat of refuse burning installations more economically, the smoke and gases passing through a heat exchanger located immediately above the combustion chamber.

DESCRIPTION OF THE PRIOR ART

In the prior art, various forms of apparatus for using the exhaust heat of the refuse burning installations have been disclosed. Examples of apparatus of this kind comprise angular tube, vertical tube, waste heat and smoke tube boilers as well as combinations of these.

In a known apparatus for using waste heat, which comprises a known angular tube or vertical tube radiation chamber, the chamber is divided into at least two compartments or zones having a more or less rectangular cross-section and being disposed one beyond the other. The smoke gas is introduced, from the combustion chamber, into the first compartment of the angular or vertical tube radiation boiler which forms a radiation chamber, passes through this compartment at low speed and thereafter reaches the following compartment which forms a convection chamber. After this second compartment, the smoke gases are passed through a gas scrubber and exhausted from the installation through the chimney.

Because of the low speed of the smoke and gas in the radiation chamber, a sufficiently long period is provided in which the gas stays in the chamber, which enables it to be burnt completely. In the radiation section of the above-mentioned radiation chamber, as the designation says, part of the smoke and gas heat is delivered mainly by radiation and absorbed by the heat carrier medium. The smoke and gas are thereby cooled to approximately 650°–750° C. Thereupon, the smoke and gas are fed to a convection heat exchanger with high speed of passage whereby the remaining heat is removed from the smoke and gas by convection.

The above-mentioned radiation chambers have, however, the disadvantage that most of the radiation surfaces can only contact the smoke and gases on one side as a consequence of which the degree of use of the heating surfaces is low which makes necessary large heat exchange surfaces and therefore bulky constructions. Because of the voluminous construction, furthermore, the expenditure for insulation of such radiation chambers is quite considerable. Additional expenditure for insulation is required by the circumstances that the face of the heat exchange element which is not in contact with the smoke and gas must also be insulated. This is necessary in order to keep heat losses as small as possible.

In a further known apparatus for using the waste heat of refuse burning plants, the smoke and gas are introduced into a waste heat or smoke tube boiler after passing through the combustion chamber.

This apparatus, which operates according to the principle of convection, has no heat yielding radiation chambers but is constructed with combustion and post-combustion chambers provided upstream and made from masonry. The theoretical smoke and gas temperature downstream of the combustion chamber is approximately 1000° C. Heat exchangers operated by the principle of convection usually only make contact with gases of temperatures of no more than between 850° and 950° C since, otherwise, considerable soiling problems would arise in the heat exchanger. If the masonry chambers are made too small, corrosion problems may arise with the convection heat exchangers to an increased extent. Reduction of smoke and gas temperature from approximately 1000° C to approximately 850° to 900° C is effected in this chamber by increase of the air ratio, i.e. by increase of the quantity of air for combustion.

The disadvantage of this apparatus with respect to the above-mentioned combinations with radiation chambers has the disadvantage that, with equal waste gas temperature, the waste gas losses grow more considerable because of the greater quantity of combustion air or smoke and gases, whereby the efficiency of the waste heat or smoke tube boiler is reduced.

Furthermore, in the waste heat and smoke tube boiler, combustion and post-combustion chambers must be provided downstream of the heat transfer chambers which must be built in masonary which requires additional investment.

The known embodiments of chambers in refuse combustion installations furthermore have the disadvantage that they need, for construction reasons, a framework, partially for supporting the parts of the chambers under pressure, partially for walkways and steps as well as sometimes for necessary auxiliary installations which also requires increased investment.

The radiation heat exchangers of the known of the known angular or vertical tube chambers as well as combinations of these with a waste heat or smoke tube chamber have furthermore the disadvantage that they consist of a construction of ribbed tubes, tube-traverse-tube constructions or tube-tube constructions which requires considerable work for gas-tight welding and checking of the welding joints for their tightness. Furthermore defects may also arise from welding stresses which have not or only insufficiently been eliminated. The tightness must be assured since, otherwise, smoke and gases would reach the insulation or the surroundings of the furnace.

In the known constructions of furnaces, a further disadvantage consists in that they must be equipped with cleaning devices such as soot blowers, ball deliverers, heating and vibrating devices which considerably increases the necessary expenses for maintenance of the installation.

It is the purpose of the present invention to avoid the disadvantages of the prior art installations and particularly to provide a process and apparatus which assures better use of the exhaust heat of refuse burning plants. This results in reducing the volume of the construction and the investment required and, at the same time, the process of heat exchange is simplified.

According to the present invention, this is primarily achieved by allowing the smoke and gases to enter the heat exchanger directly from the combustion chamber, to pass through the heat exchanger once in the axial direction while yielding radiation heat and, thereafter, deflecting the current of smoke and gases by 180° at least once in the same heat exchanger and guiding the smoke gases along the heat exchange element on the inside and on the outside coaxially with the feed current whereby convection heat is exchanged.

While the gas current passes through the heat exchanger for the first time, the heat exchanger mainly absorbs radiation heat from the smoke and gases, whereby lowering of the input temperature of the smoke and gases is achieved which makes possible feeding to a convective heat exchanger. Since the smoke and gases are thereafter deflected at least once by 180° in the same heat exchanger and guided along the inside as well as along the outside of the heat exchanger elements, each heat exchanger element can be used for heat exchange on both sides. After the first deflection of the current of smoke and gas by 180°, the heat exchange is effected mainly by convection. The uninterrupted use of the heat exchange processes renders possible the use of all the sides of the heat exchange elements and has the advantage of more economic heat delivery and accordingly an increase of efficiency of the heating surface. At the same time, constructional expenses are reduced considerably.

In a further embodiment of the process of the present invention, the smoke and gases and the heat carrier in the heat exchange elements move approximately vertically with respect to each other whereby essential improvements of the heat exchange efficiency are achieved.

A further purpose of the present invention consists in providing an apparatus for effecting the process of the present invention which renders possible a more economical and cheaper construction of refuse burning plants.

A further purpose of the present invention consists in providing an apparatus of the above-mentioned type which makes possible the use of a stable, self-supporting construction of heat exchanger while assuring a most compact construction.

According to the present invention, this purpose is achieved primarily by disposing the heat exchanger immediately downstream of the combustion chamber and by providing a heat exchanger that consists of at least two tube packs arranged coaxially within each other and having concentric cross-sections, smoke gas ducts being provided between the individual tube packs as well as in the core of the innermost pack and between the outermost pack and the enclosure of the heat exchanger.

This renders possible in a simple manner a spacesaving and compact embodiment of the heat exchanger because the radiation chamber and the convection chamber are disposed concentrically with respect to each other. By the jacket-like shape of the individual tube packs made of coiled tubes, a rigid and self-supporting construction of the heat exchanger is assured. Since each winding of the coiled tube packs lies close to the next coil, the weight of the tube packs assures a sufficiently gas-tight construction without the necessity of special measures such as, for example, welding. The self-supporting tube packs can be supported by the walls of the combustion chamber and/or by a foundation without additional support structures.

The space-saving and compact embodiment of the heat exchanger furthermore reduces the expenditure for insulation to a comparatively small value since it is only necessary to insulate the enclosure of the heat exchanger.

Advantageously, the smoke gas ducts between the tube packs and between the outermost tube pack and the enclosure have a circular cross-section. Depending on necessity, also other types of cross-section can be used.

In a preferred embodiment of the invention, the individual coils of the coiled tube baskets may be multiple-windings whereby the principle of natural circulation can be applied in a particularly advantageous manner.

Advantageously, the individual tube packs can be divided into partial packs whereby the individual partial packs, depending on use of the heat exchanger, may serve as feed water preheaters, pre-evaporators, evaporators or superheaters.

Depending on the cross-section of the tubes of the tube packs, it is possible to operate the apparatus of the present invention with natural circulation, forced circulation or with forced through-put of the heat carrying medium.

Contrary to the known plants, in the embodiment of the present invention, equipment or measuring instruments can be arranged in the zone of the cover of the chamber or of the lower deflection zone. Thereby, the amount of walk ways and steps can be limited.

The tendency of the heating surface tubes to become soiled is reduced since the ducts past the tubes have a larger open width. Should intermediate cleaning all the same become necessary during operation, this can be done in a most simple manner by hand through openings in the cover of the chamber. At the same time, the chamber can also be examined or walked through from the cover side which makes the inspection of the chamber much more easy.

As appears from the above, the technical progress and the inventive features of the object of the present invention are assured by the novel individual features as well as, particularly, by their combinations and subcombinations.

DESCRIPTION OF THE DRAWINGS

The invention will be explained hereinafter in more detail by describing practical examples with reference to the accompanying drawings wherein:

FIG. 1 shows schematically the essential elements of a refuse burning plant. The refuse to be burnt is fed to the plant by means of a known transport installation, not described in detail, through a refuse feed shaft 2, and to a stepped grate 1. Below the stepped grate 1, collection funnels 8 and 9 are provided in known manner for collecting slag and ash. The refuse burning plant furthermore comprises a combustion chamber 18 and a smoke gas channel 3 within which a heat exchanger 4, consisting of three cylindrical packs of tubes 5, 6 and 7 coaxially disposed within each other is arranged. The tube packs 5, 6 and 7 have a circular cross-section and each consists of one or several coils of tubes.

Figure 1:
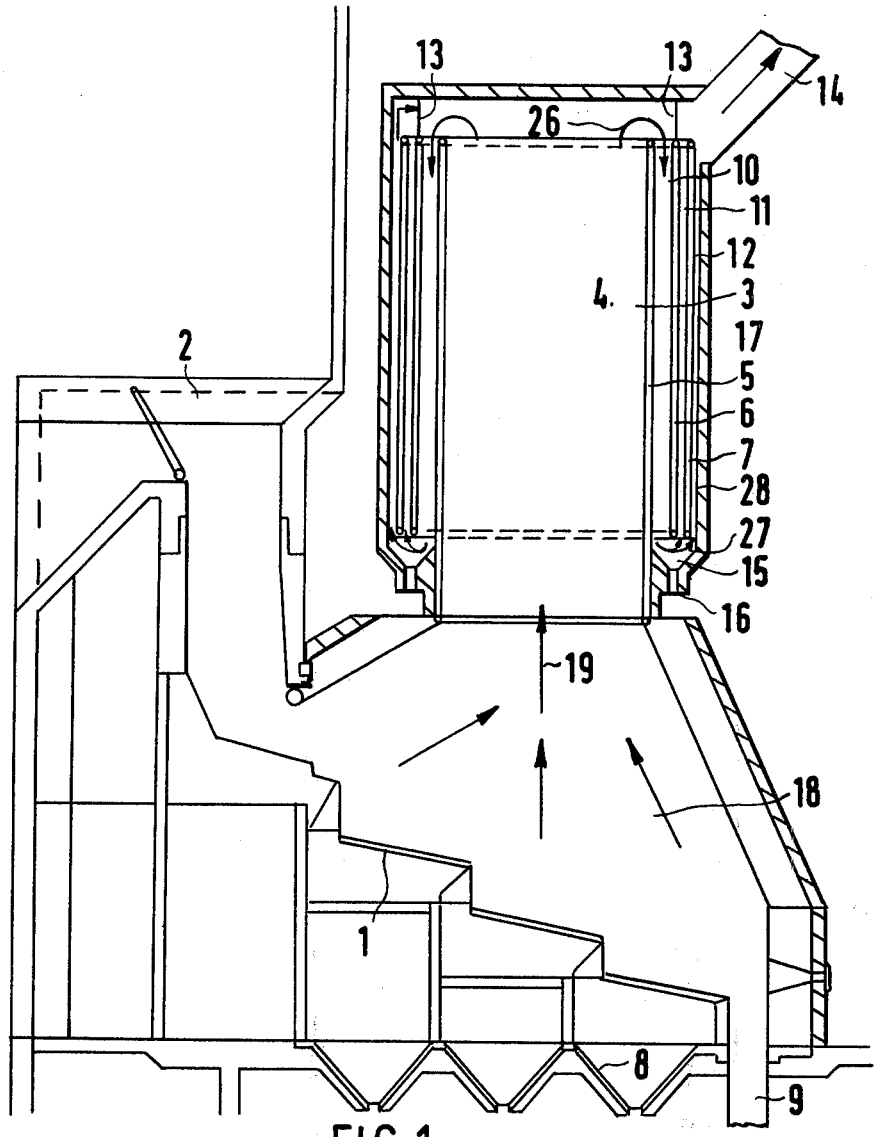
FIG. 1 shows a schematic cross-section through a combustion chamber and a heat exchanger of a refuse burning plant.

The smoke and gases pass from the combustion chamber 18 in the direction of arrow 19 into the heat exchanger 4. The path of smoke and gas in smoke ducts 10, 11 and 12 within the heat exchanger 4 is indicated by arrows 26 and 27.

Because of the large free cross-section within the interior tube pack 5, the smoke and gas flows relatively slowly through this pack, and the inner face of this tube pack is mainly heated by radiated heat. Therefore, it is not necessary to subject the smoke and gases which enter the heat exchanger 4 from combustion chamber 18 and have a temperature of approximately 1000° to additional cooling, and the smoke and gases are led directly into the heat exchanger.

After the smoke and gases have left the inner tube pack 5, they are deflected by 180° and led to a first smoke duct 10 of circular cross-section which is formed by the inner face of the middle tube pack 6 and the outer face of the inner tube pack 5. Since the cross-section of the first smoke duct is smaller than the free circular cross-section on the inside of the tube pack 5, the smoke and gas in this annular channel forms a current of comparatively high speed, whereby the outer face of the inner tube pack 5 and the inner face of the middle tube pack 6 are heated by convection heat.

After the smoke and gases have left the first smoke duct 10, they are again deflected by 180° and at the same time fed to a second smoke duct 11 and a third smoke duct 12. The second smoke duct 11 is formed in this case by the outside of the middle tube pack 6 and by the inside of the outer tube pack 7. The third smoke duct 12 is formed by the outside of the tube pack 7 and the inside of an enclosure 28.

The cross-section of the second smoke duct 11 and of the third smoke duct 12 together is smaller than the cross-section of the first smoke duct 10 so that the smoke and gases within the second and third smoke duct 11 and 12 have still a comparatively high speed in spite of the previous cooling. By the smoke and gases flowing through the second smoke duct 11, the outside of the middle tube pack 6 as well as the inside of the outer tube pack 7 are fed with convection heat. The outside of the outer tube pack 7 is thereby also fed with convection heat by the smoke and gas flowing through the third smoke duct 12.

In the smoke ducts 10, 11 and 12, the smoke and gas flows approximately at a right angle with respect to the heat carrier medium in the tubes of tube packs 5, 6 and 7. Thereby, in comparison with tubes which extend in parallel with the current of smoke and gas, the heat transfer from the smoke and gas to the heat carrier medium can be improved by up to 50%. As a consequence of this, the same heat quantity can be transferred by smaller exchange surfaces while the remaining conditions remain unchanged.

After leaving the smoke ducts 11 and 12, the cooled smoke and gas is fed to a collecting tube 14 formed on one side by the enclosure 28 and on the other side by a separation wall 13. Thereafter, the smoke and gas is fed to a known gas scrubber, not described in detail and leaves the plant a chimney.

Since the enclosure 28 only comes into contact with smoke and gases of low temperature, only a thin layer of insulation material 17 has to be provided. Since the pressure decrease between the inside and the outside of the tube packs 5, 6 and 7 is relatively small, no additional sealing is necessary. Only the enclosure 28 must be made tight to prevent smoke and gases from reaching the surroundings.

Between the inner tube basket 5 and the lower end of the enclosure 28, there is provided a hopper-shaped ash collector 15 for collecting a part of the ash in the smoke and gas. The collected ash passes through openings 16 of the ash collector.

Since the individual tube packs 5, 6 and 7 of the heat exchanger 4 are rigid and self-supporting, these can be carried directly by the foundation of the apparatus or by the masonry of the combustion chamber in the processing path of a refuse burning plant so that no further support structures are necessary in the zone of the heat exchanger 4.

For cleaning the smoke ducts, openings are provided in the cover of the enclosure 28 through which the tube packs can be cleaned in a simple manner by hand held mechanical devices.

In the above described arrangement, the tube packs are connected with each other so that they can be operated as feed water preheaters, pre-evaporators, evaporators or superheaters.

Figure 2:
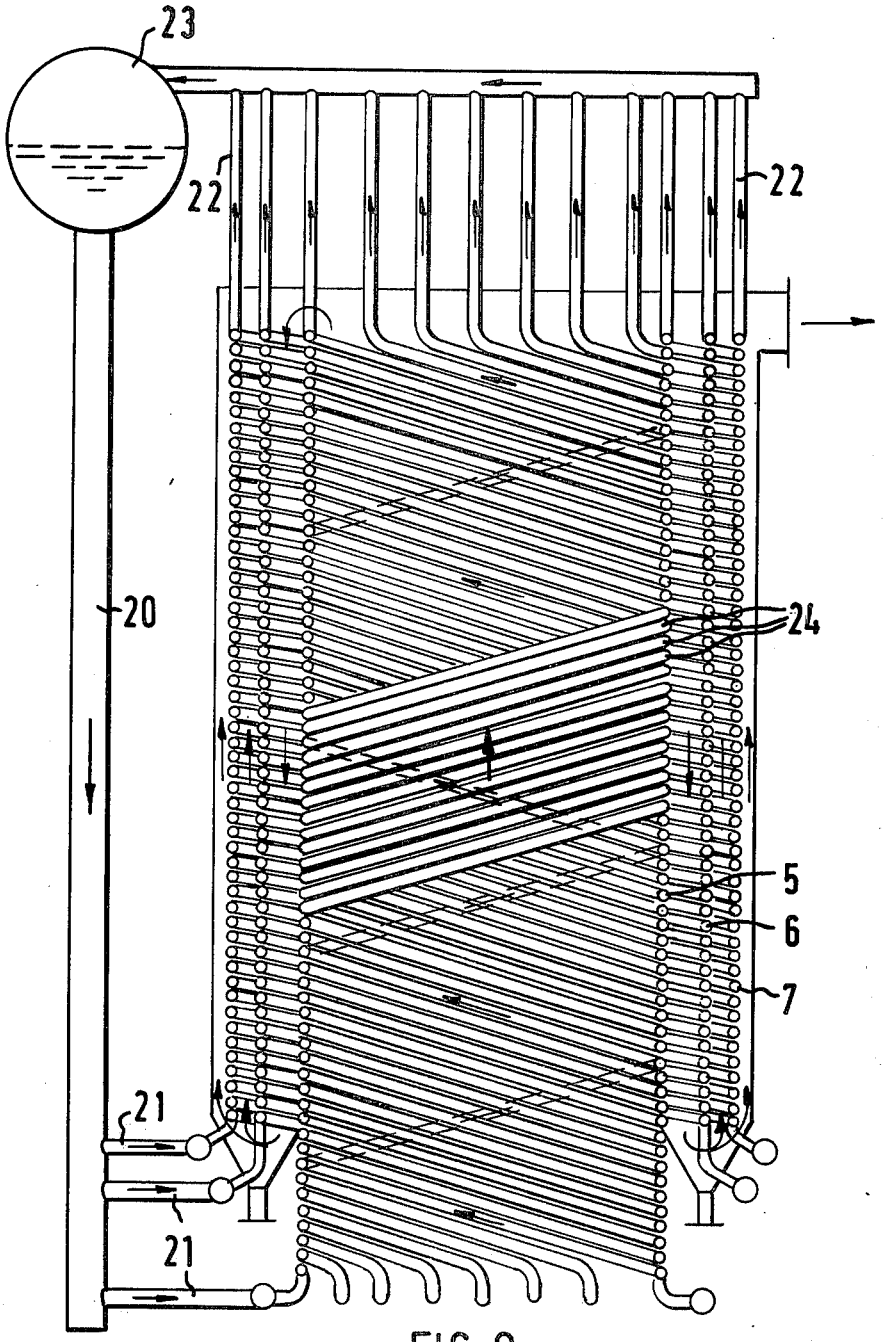
FIG. 2 is a schematic cross-section through a heat exchanger arranged for natural circulation of fluid and provided with three cylindrical tube packs arranged concentrically.

FIG. 2 shows a schematic cross-section of the heat exchanger 4 connected for the natural circulation of water and stream and which consists of three tube packs 5, 6 and 7 arranged concentrically within each other. The heat exchanger 4 is shown as a simple saturated steam generator without feed water preheater, pre-evaporator and superheater. As shown, therefore, the individual tube packs are connected only to provide evaporating heating surfaces so that they receive the circulating water through a down tube 20 and through distributors 21. The water/steam mixture is delivered to a drum 23 through steam exhaust tubes 22. Since the cross-section of the tubes of the individual tube packs 5, 6 and 7 is sufficiently large, and water/stream mixture flows through the tube packs because of the transport pressure produced by hydrostatic buoyancy forces.

As furthermore shown in FIG. 2, the tube packs 5, 6 and 7 are multitube units each being formed of a helical tube pack consisting of fourteen parallel tubes 24 whereby the tube cross-section necessary for the hydrostatic buoyancy forces is increased. Thus each pack consists of fourteen helical tubes, each extending from end to end of the tubular pack unit on a single cylindrical notional surface with convolutions of respective ones of said helical tubes being arranged in repeated series along said notional surface, each series containing one convolution of each of the fourteen tubes.

Figure 3:
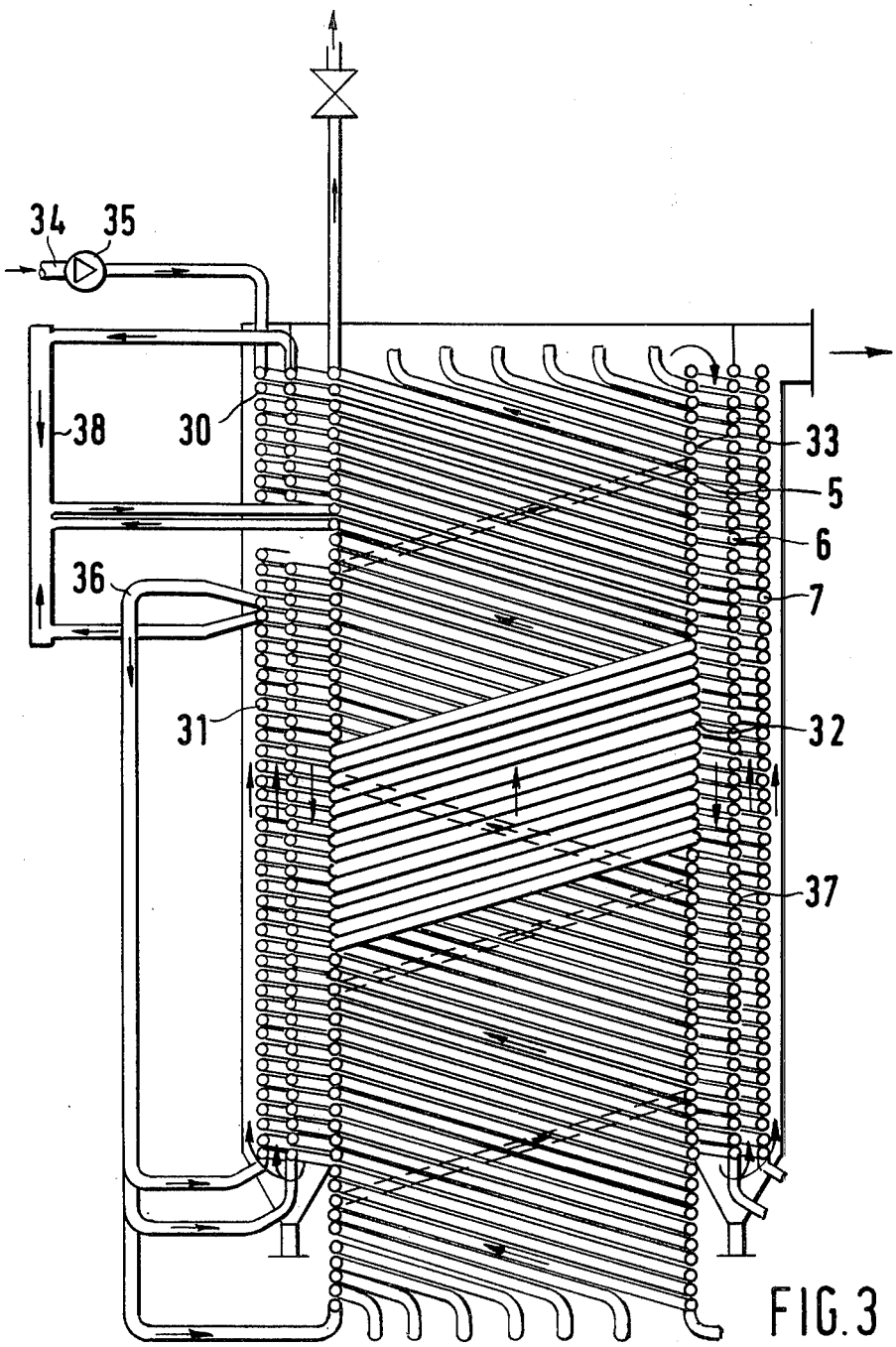
FIG. 3 is a schematic cross-section through a heat exchanger arranged for forced circulation of a fluid with three cylindrical tube packs arranged concentrically.

FIG. 3 shows a schematic cross-section of a forced flow system with three tube packs 5, 6 and 7 providing throughput steam generators.

The outer tube pack 7 is divided into a feed water preheater 30 and an evaporator portion 31. The inner tube pack 5 is also divided into two portions and has an evaporator portion 32 and a superheater 33. The middle tube pack 6 provides an evaporator 37.

The feed water is fed to the feed water preheater 30 through the feed water tube 34 by means of a pump 35. The preheated feed water is then fed to the individual parts 31, 32 and 37 of the evaporator through distribution tubes 36.

The steam coming from the evaporator portions is collected by means of a collecting tube 38 and fed to the superheater 33 for production of superheated steam.

Figure 4:
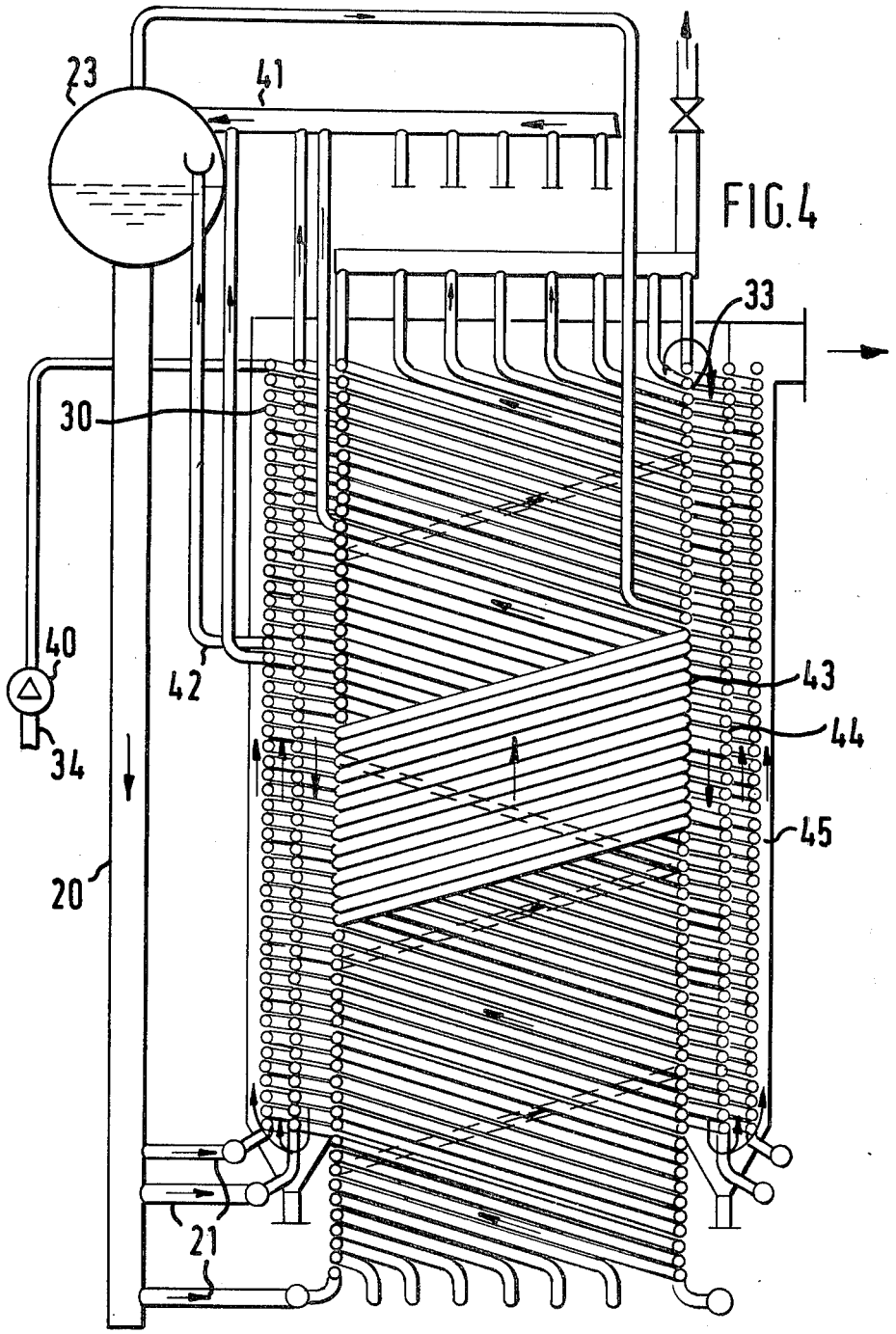
FIG. 4 is a schematic cross-section through a heat exchanger arranged for natural circulation of a fluid with feed water preheater and superheater and having three cylindrical tube packs arranged concentrically.

FIG. 4 shows a schematic legthwise section of a natural circulation system with feed water preheater 30 in the form of cylindrical tube packs 30, 43, 44 and 45 and superheater 33. The feed water passes through feed water tube 34 and through a feed pump 40 into a feed water preheater 30 with or without pre-evaporator and thereafter through a connection tube 42 into a drum 23. Through a down tube 20 leading away from the drum 23 and through distributor 21 to individual evaporator packs 43, 44 and 45. The water/steam mixture issuing from the evaporator packs 43, 44 and 45 is collected in a collector tube 41 and fed to the drum 23. For producing hot steam, the saturated steam coming from the drum 23 is fed to the superheater 33. If control of the temperature of hot steam is desired, the superheater 33 can of course be divided into several portions. Then between the individual portions of the superheater 33, several cooling devices can be inserted.

Figure 5:
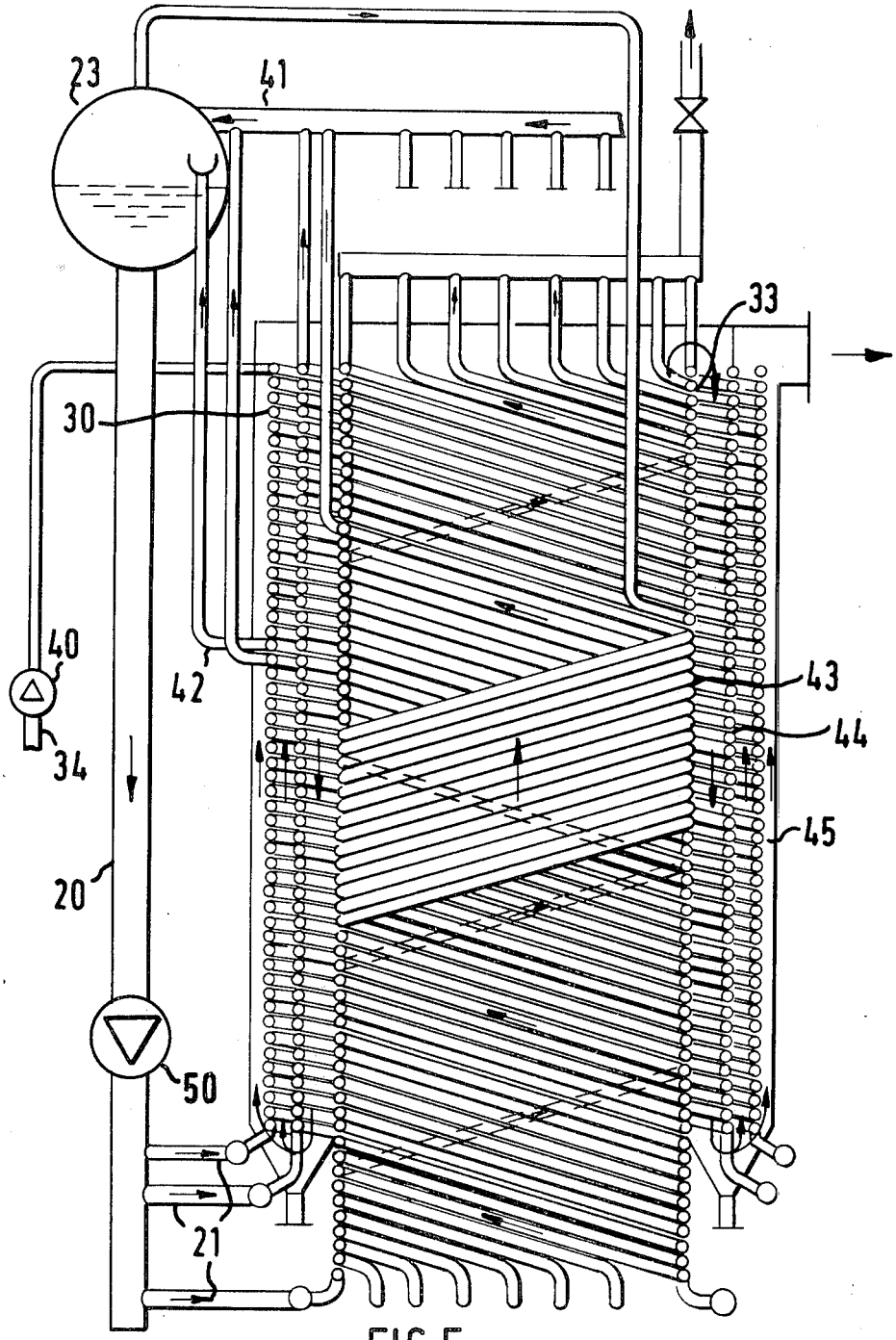
FIG. 5 is a schematic cross-section through a heat exchanger arranged for forced circulation of a fluid with feed water preheater and superheater and having three cylindrical tube packs arranged concentrically.

FIG. 5 shows a schematic lengthwise section of a forced circulation system with feed water preheater 30 and with superheater 33. The construction and connection of the feed water preheater 30 with or without pre-evaporators as well as of superheater 33 is effected as in FIG. 4. The evaporator packs 43, 44 and 45 receive the water from drum 23 through down tube 20 of circulating pump 50 and through distributors 21. The water/steam mixture issuing from the evaporator packs 43, 44 and 45 is also collected, as in FIG. 4, in a collection tube 41 and from there led into the drum 23.

Figure 6:
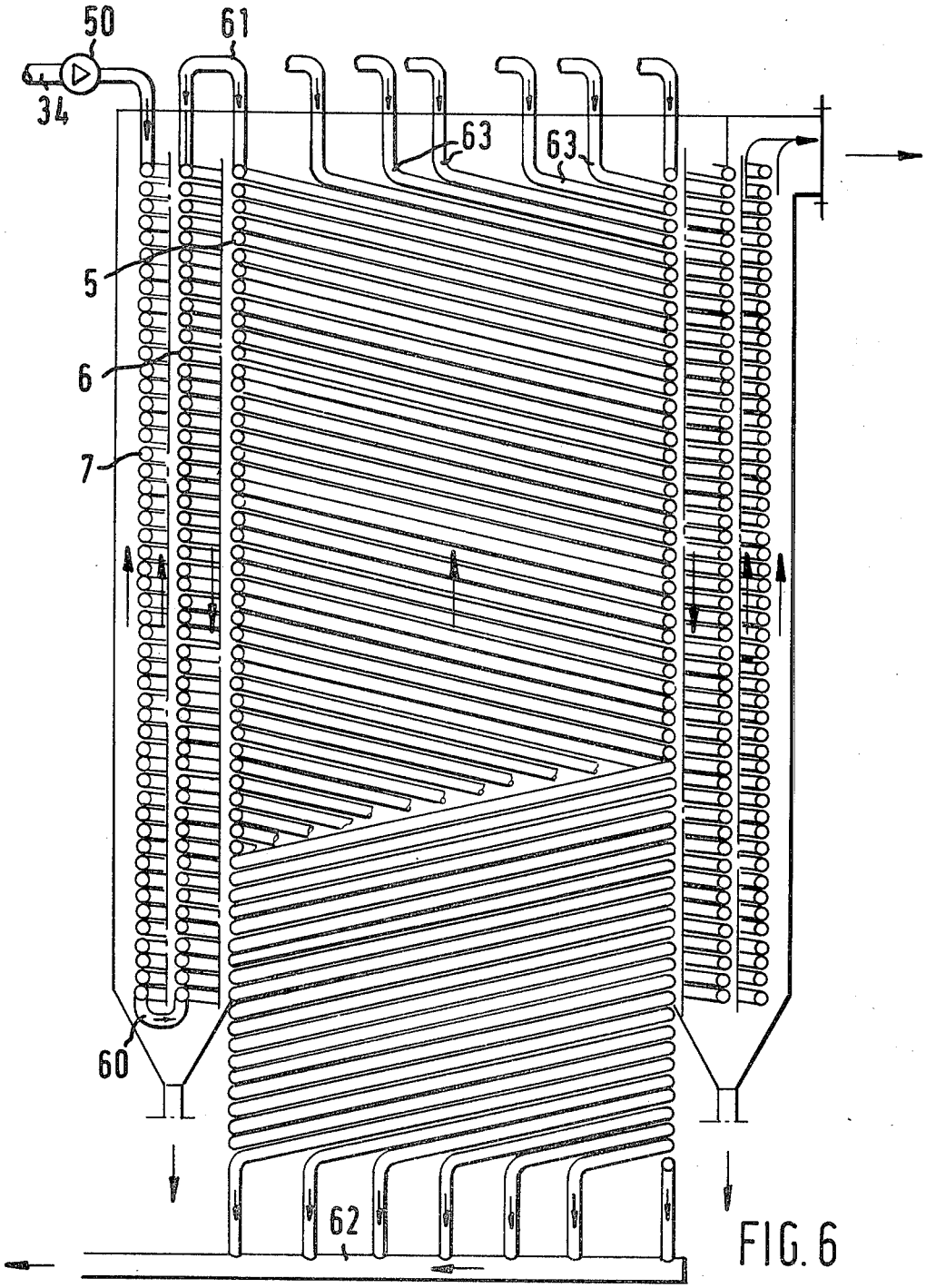
FIG. 6 is a schematic cross-section through a heat exchanger arranged for heating water and having three cylindrical tube packs connected in series and mounted concentrically.

FIG. 6 shows a schematic cross-section of apparatus with tube packs 5, 6 and 7 connected in series for the production of hot water. The feed water is fed to the outer tube pack 7 through a feed water tube 34 and through circulating pump 50. By means of a connection tube 60, the water heated by tube pack 7 is fed to the tube pack 6. The heated water coming from tube pack 6 runs into connection tubes of which it is guided onto the individual tubes of inner multitube pack 5. As shown in FIG. 6, the inner tube pack consists of twelve tubes 63 connected in parallel and wound in coils. At the lower end of the inner tube pack there is arranged a collection tube 62 which collects the water coming from tubes 63 and feeds the water to a location where it is required. In an alternative arrangement the packs 5, 6 and 7 are connected in parallel to deliver the water to be heated downwards through the helical tubes.

As becomes clear from the above, the apparatus of the present invention may be modified in many ways without thereby departing from the scope of the invention. Thus, for example, one or several tube packs can be divided into any number of partial packs which may then be used alternatively as feed water preheaters, pre-evaporators, evaporators or superheaters. Also the number of concentric tube packs can be adapted to requirements. In smaller plants, an arrangement consisting of only one tube pack may be sufficient, the smoke gases being then removed at the lower end of the heat exchanger.

I claim:

1. Apparatus for using the exhaust heat from burning refuse, comprising means providing a combustion chamber wherein refuse can be burnt, enclosure means mounted directly above said combustion chamber providing a vertically extending heat exchanger compartment for receiving smoke and gas products of combustion from said combustion chamber, said enclosure means being formed at the upper end thereof with an outlet for said smoke and gas, and a heat exchanger mounted within said enclosure means, said heat exchanger comprising at least two tube packs each consisting of a tubular unit formed by at least one helically wound tube, said tube packs being mounted concentrically with clearance therebetween and with clearance between the outer one of said concentric packs and said enclosure means whereby smoke and gas ducts are provided within the innermost one of said concentric packs, between said concentric packs and between said enclosure means and said outer one of said concentric packs, and said enclosure means being arranged for smoke and gas passing through said ducts to escape through said outlet, and means for supplying fluid to and leading fluid from the helical tubes constituting said packs.

2. Apparatus according to claim 1, in which said packs are formed for the path of the smoke and gas therethrough to be approximately perpendicular to the convolutions of the helically wound tubes forming said packs.

3. Apparatus according to claim 2, in which each of said ducts has a circular cross-section.

4. Apparatus according to claim 1, in which each of said packs consists of a single layer of helical convolutions constructed as self-supporting unit mounted at its lower end of said means providing a combustion chamber.

5. Apparatus according to claim 1, in which said packs are constituted by single layers of helically wound tubes each having its adjacent convolutions in close contact with one another.

6. Apparatus according to claim 5, in which the innermost one of said packs consists of a plurality of helical tubes each extending from end to end of the tubular pack unit on a single cylindrical notional surface with convolutions of respective ones of said helical tubes arranged in repeated series along said notional surface, each series containing one convolution of each of said helical tubes.

7. Apparatus according to claim 1, in which at least one of said packs is composed of a single layer of helical tubes and is divided into two sections one above the other, said means for supplying fluid to and leading fluid from said helical tubes including means for delivering fluid to and from each of said sections separately.

8. Apparatus according to claim 7, in which said means for delivering fluid to and from each of said sections is arranged to supply water to the top of the upper one of said sections to be preheated therein, to deliver preheated water from the bottom of said upper section, to deliver preheated water to the bottom of the lower one of said sections and to the bottom of said innermost packs, for evaporation therein, said innermost pack also being devided into two sections and said means for supplying fluid to and leading fluid from said helical tubes comprising mean for leading evaporated steam from the lower one of said sections of said innermost pack, leading evaporated steam to the upper one of the sections of said innermost pack and leading superheated steam from said last-mentioned section.

9. Apparatus according to claim 1, in which said means for delivering fluid to and leading fluid from said helical tubes comprises means connecting said packs to form a series thereof, means for delivering water to said series at one end thereof and means for withdrawing hot water from said series at the other end thereof.

10. A process for economically for economically using the exhaust heat of refuse, comprising the steps of burning refuse in a combustion chamber to generate smoke and gas therefrom, passing said smoke and gas directly upwards through a tubular unit consisting of at least one helically wound tube thereby heating said unit by radiant heat, deflecting said smoke and gas through 180° at the top of said unit so as to pass downwards between the outside of said unit and a second tubular unit containing said first unit and also consisting of at least one helically wound tube, deflecting said smoke and gas through 180° at the bottom of said second tubular unit so as to pass upward between said second tubular unit and a wall forming part of a compartment containing said tubular units thereby heating said second unit by convection heat, discharging said smoke and gas from said compartment at the top thereof, and passing fluid through said helically wound tubes while said smoke and gas is flowing over said units.

* * * * *